United States Patent [19]

Newcomb

[11] 4,200,160

[45] Apr. 29, 1980

[54] SWEEP PICKUP FOR A BIG HOLE BIT

[75] Inventor: Alan L. Newcomb, Rancho Palos Verdes, Calif.

[73] Assignee: Smith International, Inc., Newport Beach, Calif.

[21] Appl. No.: 885,882

[22] Filed: Mar. 13, 1978

[51] Int. Cl.[2] ..... E21C 13/02

[52] U.S. Cl. ..... 175/340; 175/393; 175/213

[58] Field of Search ..... 175/325, 339, 340, 374, 175/393, 213; 299/81

[56] References Cited

U.S. PATENT DOCUMENTS

| | | | |
|---|---|---|---|
| 3,384,191 | 5/1968 | Schumacher, Jr. et al. | 175/340 |
| 4,105,083 | 8/1978 | Allen | 175/313 |

FOREIGN PATENT DOCUMENTS

| | | | |
|---|---|---|---|
| 790457 | 7/1968 | Canada | 175/340 |

*Primary Examiner*—Ernest R. Purser
*Assistant Examiner*—Nick A. Nichols, Jr.
*Attorney, Agent, or Firm*—Robert M. Vargo

[57] ABSTRACT

A sweep pickup for a large diameter drill bit is disclosed. The drill bit includes a main bit body having a plurality of roller cutters rotatively mounted thereon. Drilling fluid is pumped down the annulus of the well bore, across the face of the bit and up a central passage located within the bit. A sweep pickup is connected to the central passage and includes a lower inlet having a semicylindrical chamber mounted adjacent the trailing side thereof. A flexible wiper blade is located on the leading edge of the sweep pickup tube adjacent the inlet and is adapted to contact the base of the well bore in order to agitate and project the drilled cuttings into the flow of the drilling fluid. The wiper blade also functions to block the fluid flow to the inlet of the sweep pickup from the leading side thereof, thereby creating a unidirectional fluid flow to the inlet of the sweep pickup from the trailing side thereof. The semicylindrical chamber has the open side facing the bore hole bottom and functions to create a vortex at the inlet of the pickup tube thereby creating turbulence at the inlet for assisting in raising the cuttings off the base of the well bore and into the flow of the circulating fluid.

8 Claims, 4 Drawing Figures

SWEEP PICKUP FOR A BIG HOLE BIT

BACKGROUND OF THE INVENTION

1. Field of the Invention

The present invention relates generally to large diameter drilling apparatus for drilling large well bores and, more particularly, to circulation systems for transporting to the surface earth cuttings and drilling fluids flowing into the well bore.

2. Description of the Prior Art

Large diameter shafts are basically utilized in the mines for rescue, ventilation, ore and coal hoisting, and general access purposes. In recent years, large diameter shafts have been utilized for emplacing nuclear devices.

Large diameter shafts are usually drilled with rotary flat bottom bits which comprise a main bit body having a plurality of rotatively supported roller cutters attached thereto. The cutters function to contact and disintegrate the earth formation at the bottom of the shaft, thereby creating cuttings or chips at that location.

Various circulation systems utilizing water or drilling mud have been used to flush the earth cuttings away from the shaft bottom. Such circulation systems are usually classified as either direct or reverse circulating systems. In the direct circulation systems, drilling fluid is pumped down the center drill column, across the face of the drill bit at the bottom of the shaft, and up through the annulus of the shaft. In the reverse circulating systems, the drilling fluid is pumped down the shaft annulus to the bottom of the shaft, across the face of the drill bit and up through the center drill column back to the surface. In both systems, when the drilling fluid transporting the chips and cuttings reaches the surface, the fluid is usually pumped through various separating and cleaning devices to separate the cuttings, silt, gas and other materials from the drilling fluid in order to enable the cleaned drilling fluid to be recirculated for further use.

The biggest problem today in drilling large diameter well bores lies in the removal of the drilled cuttings from the bottom of the well bore during the drilling operation, otherwise known as bottom hole cleaning. If the removal of the drilled cuttings is not accomplished efficiently, the cuttings would be reground a large amount before being removed. Regrinding these cuttings to a fine size requires large amounts of energy, decreases the penetration rate and decreases the life of the cutters.

One approach to this problem is described in U.S. Pat. No. 3,360,061. In that patent, a well apparatus is described wherein high pressure gas from gas passages is directed against the bottom of the well bore below the drill to agitate the cuttings and liquids in the well bore. Such nozzles are well known in the art. The problem that still exists with such systems lies in the picking up of the cuttings off bottom to transport it to the surface. The sweep pickups, such as that described in the above-mentioned patent simply do not operate efficiently to alleviate the cutter regrinding problem. Such sweep pickups have inlets allowing for flow from all directions. These opposing flow paths create a stagnation zone at the mid-line of the sweep intake slot close to the base of the bore hole. This stagnation zone prevents the cuttings from being raised from the floor of the bore hole into the flow of the circulation fluid.

SUMMARY OF THE INVENTION

The present invention obviates the above-mentioned problems by providing a sweep pickup for big hole bits that operates efficiently to remove cuttings from the bottom of the well bore.

In its broadest aspect the present invention pertains to a sweep pickup for a large diameter bit in which the sweep pickup includes structure for creating a fluid vortex to assist in raising the cuttings off the base of the bore hole and transporting them up the center of the bit.

The sweep pickup also utilizes a flexible wiper blade mounted on the forward side of the sweep pickup for assisting in creating a unidirectional flow through the sweep pickup, thereby eliminating any stagnation zones, and for dislodging the cuttings off of the base of the bore hole and projecting them into the turbulent flow of the circulating fluid.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DESCRIPTION OF THE PREFERRED EMBODIMENT

Figure 1:
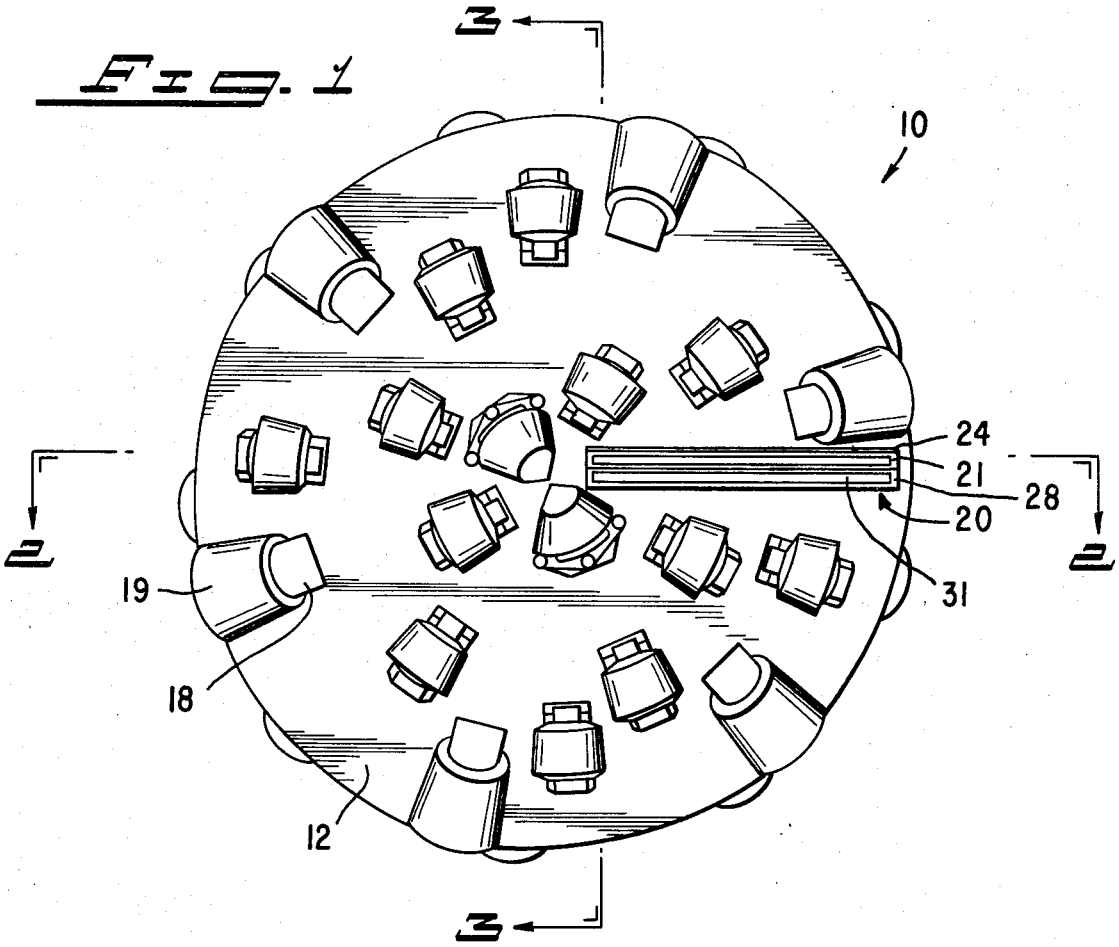
FIG. 1 is a bottom elevational view of a large diameter drill bit.
Figure 2:
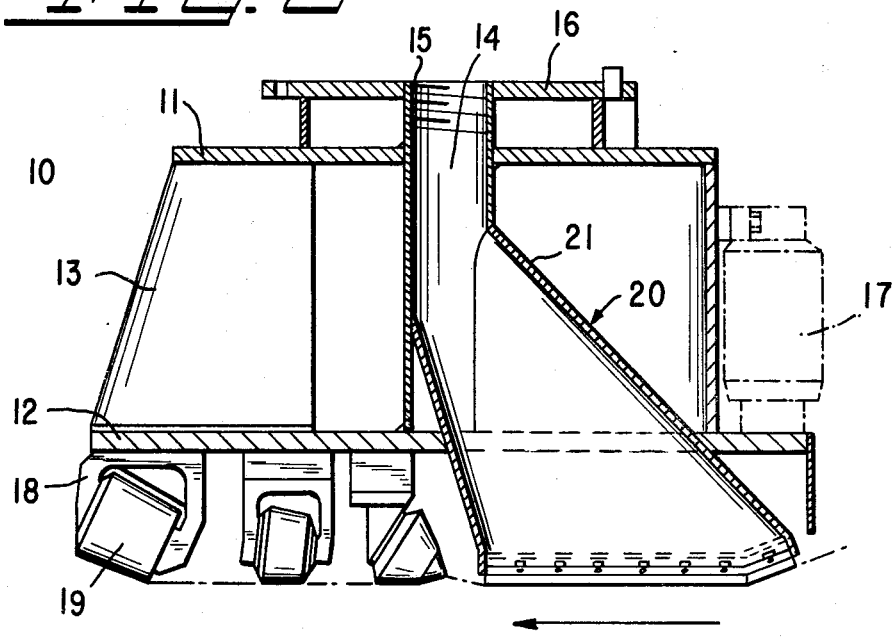
FIG. 2 is a sectional view of the drill bit taken along lines 2—2 of FIG. 1.
Figure 3:
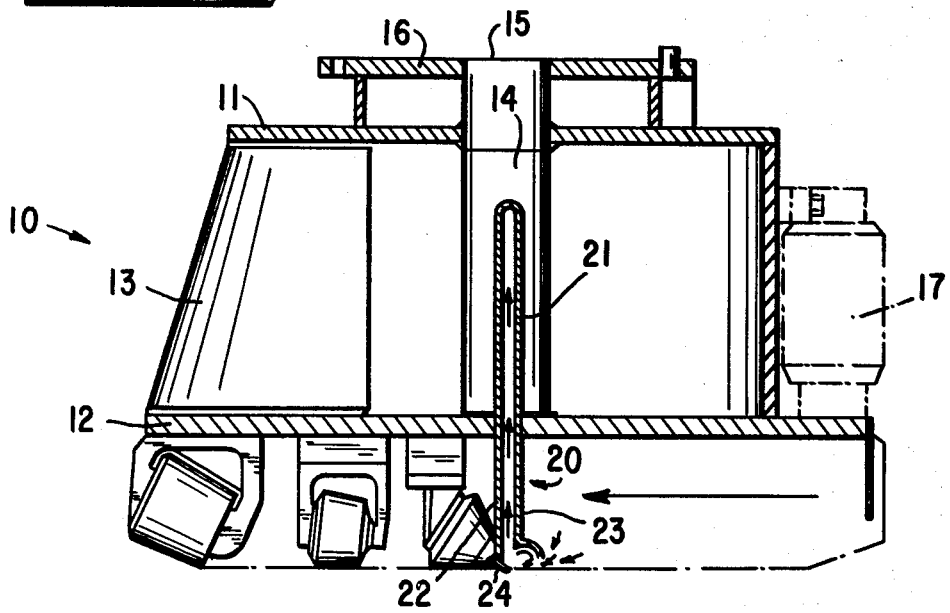
FIG. 3 is a sectional view of the drill bit taken along lines 3—3 of FIG. 1.

Referring now to the drawings, FIGS. 1, 2 and 3 illustrate a large diameter bit generally indicated by arrow 10. Such bits are commonly termed Big Hole Bits. The diameters of such bits range from 6 feet to 20 feet. The drill bit 10 comprises a main bit body comprising an upper plate 11 and a lower plate 12 having a plurality of vertically oriented plate members 13 integrally connected thereto.

A hollow stem 14 extends vertically through the center of the drill bit body and is integrally connected to the upper and lower plates 11 and 12 respectively.

A threaded coupling 15 is formed at the top of the hollow stem 14 for connection to the bottom of a drill column (not shown). The hollow stem 14 functions to receive drilling fluid from a sweep pickup generally indicated by arrow 20, as it passes upwardly through the interior of the drill column. The sweep pickup will be discussed in greater detail hereinafter.

The drill bit 10 further includes a mounting plate 16 integrally connected to the upper plate 11. A plurality of roller stabilizers 17 are vertically mounted about the circumference of the drill bit body. Clear views of the stabilizers 17 are shown in FIGS. 2 and 3.

A plurality of yokes 18 are integrally attached to the bottom of the lower plate 12 for rotatively supporting a plurality of roller cutters 19. Such cutters 19 may be of the milled teeth type or the type having tungsten carbide inserts mounted thereon.

As shown in FIG. 1 these cutters are radially and circumferentially spaced about the lower face of the bit 10 in such a manner that the entire bottom face of the bore hole is covered by the cutters 19. The cutters 19 function to contact and disintegrate the earth formation at the face of the bore hole. Drilling fluid is pumped down the annulus between the bore hole and the drill column to the bore hole bottom to pickup the cuttings made by the roller cutters 19. The fluid and cuttings are then drawn upwardly through the hollow stem 14. Generally speaking, after the drilling fluid reaches the top of the bore hole the cuttings are separated from the drilling fluid and the drilling fluid is recirculated down the bore hole to clean the bottom face of the bore hole once again.

The sweep pickup 20 will now be described in greater detail. As shown in FIG. 2, the sweep pickup 20 includes an inlet housing 21 in which the lower portion extends radially from the center of the drill bit face to the circumference thereof. The inlet housing 21 is designed to provide a smooth stable flow transition into the hollow stem 14 so as to minimize pressure loss and erosion wear and maintain efficient material transport.

As more clearly shown in FIG. 3, the bottom of the inlet housing 21 opens near the face of the well bore and includes a leading side 22 and a trailing side 23. These sides are determined on the basis of the direction of motion of the sweep pickup 20.

A flexible wiper blade or shroud 24 is suspended at the base of the inlet housing 21 on the leading side thereof. The flexible wiper blade 24 comprises a pair of elongated sheets of steel 25 and rubber 26, respectively, which are mounted on a support flange 27. The sheets 25 and 26 are secured to the support flange 27 and are adapted to engage the lower edge of the inlet housing 21. The cantilevered ends of the sheets 25 and 26 are adapted to be flexed upwardly by the contact with the face of the well bore. Normally, the sheets 25 and 26 would project outwardly on a flat plane as indicated in phantom in FIG. 4.

The flexible wiper blade 24 has two functions. The first function is to block off the flow from the leading side of the sweep pickup 20 to create a unidirectional flow of drilling fluid into the inlet housing 21 via the trailing side of the pickup 20. The second function of the flexible wiper blade 24 is for the sheets 25 and 26 to contact the cuttings located at the base or face of the well bore to dislodge them from the bore hole face and project them upwardly into the flow of drilling fluid passing into the inlet of the pickup 20.

The sweep pickup 20 further includes a semicylindrical chamber 28 mounted at the base of the inlet housing 21 on the trailing side thereof. The housing 28 is reinforced to the inlet housing 21 by means of plates 29 and 30. The semicylindrical chamber 28 has an opening 31 which faces the bottom of the well bore and into the direction of the flow of the drilling fluid. The function of the semicylindrical chamber 28 is to create a vortex within the chamber 28 caused by the fluid flow passing beneath the opening 31. The resultant fluid vortex creates a turbulance at the inlet of the sweep pickup. This turbulance tends to also assist in agitating and picking the drilled cuttings off the base of the well bore to carry them into the fluid flow traveling up the inlet housing 21 of the sweep pickup 20.

OPERATION

Figure 4:
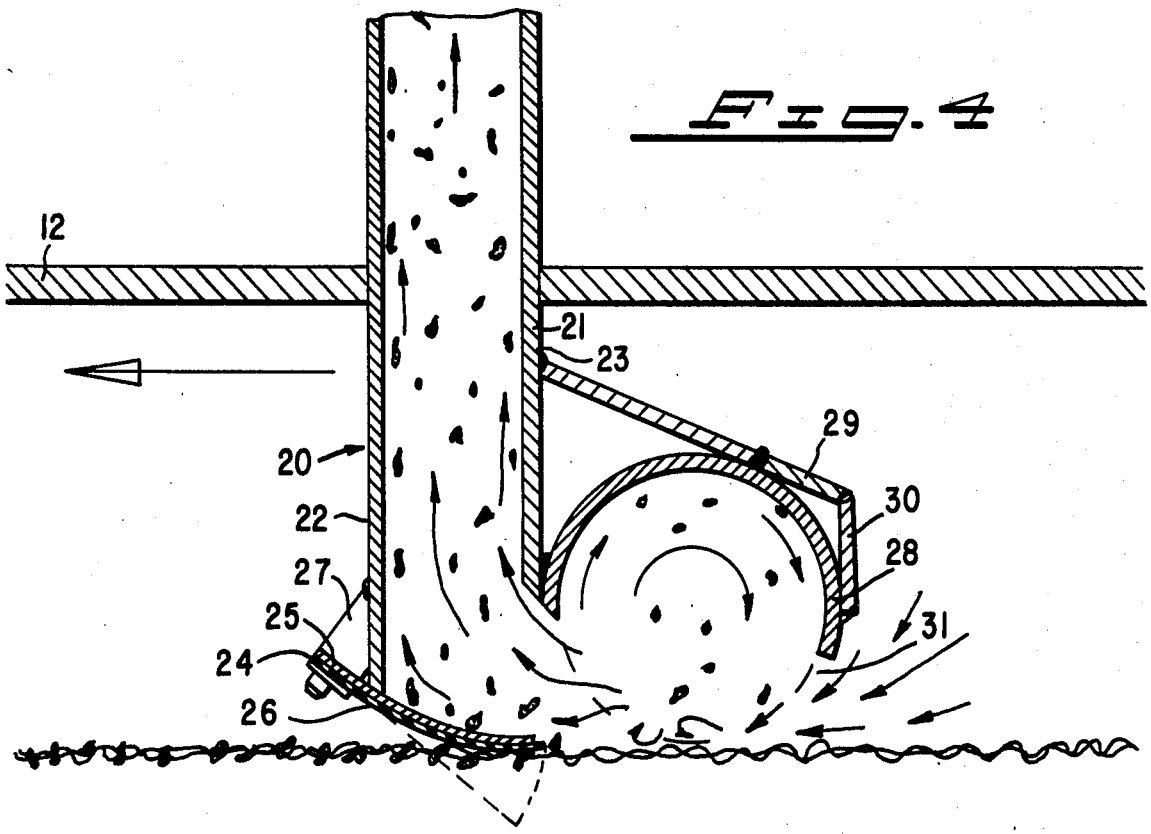
FIG. 4 is an enlarged fragmentary sectional view of the sweep pickup in accordance with the present invention.

In operation, the big hole bit 10 is rotated in a counter-clockwise direction as shown in FIG. 1. In FIGS. 2–4 the direction of movement of the components is from right to left as indicated by the arrows. During rotation, the cutters 19 engage and disintegrate the formation at the base of the bore hole to form cuttings. While this action is occurring, drilling fluid is pumped down the annulus between the wall of the well bore and the outside of the drill column. Upon reaching the base of the well bore, the drilling fluid moves radially inward across the face of the well bore. During this traversal, the fluid functions to cool the roller cutters 19 and to pick up the cuttings from the bottom of the well bore as it flows across the face thereof. The drilling fluid is then continuously pickup up by the sweep pickup 20 as it rotates and traverses across the bottom of the bore hole. During this rotating motion, the flexible wiper blade 24 is flexed against the face of the formation to block the flow of drilling fluid into the inlet of the pickup 20 from the leading side thereof. As stated previously, this creates a unidirectional flow into the inlet of the sweep pickup 20 from the trailing edge thereof, as the sweep pickup 20 moves in its rotational directions. The flexible wiper blade 24 also functions to conatct, dislodge and agitate the cuttings as it passes over the face of the bore hole. Therefore, as the drilling fluid flows across the inlet 21, the fluid picks up the additional cuttings agitated by the wiper blade 24.

Moreover, as the fluid flow passes across the opening 31 of the semicylindrical chamber 28, a vortex is created by this action, which functions to create turbulance at the mouth of the inlet 21. This turbulance also functions to assist in raising the cuttings off the formation face and into the flow of the drilling fluid. The fluid with the cuttings is then drawn up the inlet 21 and into the stem 14 to be transported up the drill column.

As can be seen, the sweep pickup 20 functions to greatly assist in cleaning the bottom of the bore hole by efficiently removing the cuttings and reducing the amount of cutting regrinding.

It should be noted that various modifications can be made to the assembly while still remaining within the purview of the following claims. For example, other chamber configurations, although not necessarily as efficient, can be utilized to create a vortex. Other configurations of wiper blades can also be utilized to work just as efficiently.

What is claimed is:

1. A large diameter drill bit adapted to rotate in one direction comprising:

a main bit body having a base section for rotatively supporting a plurality of cutters, said main bit body further having a central conduit formed therein for receiving drilling fluid, a sweep pickup communicating at one end with said central conduit with the other end extending downwardly to the face of the bore hole to form a sweep inlet, said sweep inlet having leading and trailing sides, said sweep pickup further having means for creating a fluid vortex adjacent to the sweep inlet, said fluid vortex creating means comprising a semi-cylindrical chamber having an opening facing the sweep inlet, said chamber being located adjacent the trailing side of the sweep inlet.

2. The combination of claim 1 wherein said sweep pickup further includes means for agitating the face of the bore hole adjacent the inlet of the sweep pickup, said sweep pickup further including means for blocking the flow of drilling fluid from the leading side of the sweep inlet.

3. The combination of claim 2 wherein said agitating means comprises a flexible wiper blade extending slightly below the cutting plane of the drill bit.

4. The combination of claim 3 wherein said wiper blade extends across the leading side of the sweep pickup.

5. The combination of claim 4 wherein said wiper blade comprises a flexible plate suspended adjacent the leading side of the sweep pickup.

6. The combination of claim 5 wherein said flexible plate is spring biased to be flexed against the surface of the well bore face.

7. The combination of claim 5 wherein said flexible plate is supported at one end and cantilevered in the direction of the sweep inlet at the other end.

8. The combination of claim 6 wherein said flexible plate includes a metal plate adjacent a rubber plate.

* * * * *